US010077632B2

(12) United States Patent
Hawkins, III

(10) Patent No.: US 10,077,632 B2
(45) **Date of Patent: *Sep. 18, 2018**

(54) PILOT INSIDE A BALL SUITABLE FOR WELLBORE DRILLING OPERATIONS

(71) Applicant: Drilling Innovative Solutions, LLC, LaFayette, LA (US)

(72) Inventor: Samuel P. Hawkins, III, Scott, LA (US)

(73) Assignee: Drilling Innovative Solutions, LLC, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/291,788

(22) Filed: Oct. 12, 2016

(65) Prior Publication Data

US 2017/0101852 A1 Apr. 13, 2017

Related U.S. Application Data

(63) Continuation-in-part of application No. 14/880,929, filed on Oct. 12, 2015.

(51) Int. Cl.

| | |
|---|---|
| ***E21B 34/10*** | (2006.01) |
| ***E21B 34/14*** | (2006.01) |
| ***E21B 21/10*** | (2006.01) |
| *E21B 34/00* | (2006.01) |

(52) U.S. Cl.

CPC ..... *E21B 34/14* (2013.01); *E21B 21/10* (2013.01); *E21B 34/10* (2013.01); *E21B 2034/002* (2013.01)

(58) Field of Classification Search

CPC ..... E21B 21/10; E21B 34/10; E21B 34/14; E21B 2034/002

See application file for complete search history.

(56) References Cited

U.S. PATENT DOCUMENTS

| | | | | |
|---|---|---|---|---|
| 3,870,101 A | | 3/1975 | Helmus | |
| 4,220,176 A | * | 9/1980 | Russell | E21B 21/10 137/496 |
| 4,254,836 A | * | 3/1981 | Russell | E21B 21/10 137/12 |
| 4,361,188 A | * | 11/1982 | Russell | E21B 34/102 166/319 |
| 4,846,221 A | * | 7/1989 | Kanemaru | F16K 5/0605 137/514 |

(Continued)

*Primary Examiner* — Matthew R Buck

(57) ABSTRACT

An apparatus, system, and method of use that enables control of fluid flow in a wellbore drill string with a pilot. The apparatus comprises a pusher rod with a bore for fluid flow contacting a rotatable ball with an internal bore comprising at least one pilot, wherein the seat between the pusher rod and the interior of the tubular prevents fluid flow. Pressure changes on the pusher rod rotate the bore of the ball in and out of contact with the bore of the pusher rod, to enable or prevent fluid flow, respectively. A method of use opens the ball by exerting pressure and/or force on the pusher rod to enable fluid through the ball by aligning the internal bores. Fluid flow is stopped by pressure exerted on the bottom of the ball causing the ball to rotate whereby the internal bore of the pusher rod is connected to the exterior surface of the ball. An accumulator can control the operations of the valve by selectively exerting pressure and/or fluid flow on the pusher rod.

18 Claims, 8 Drawing Sheets

(56) References Cited

U.S. PATENT DOCUMENTS

| | | | | |
|---|---|---|---|---|
| 5,553,672 | A * | 9/1996 | Smith, Jr. | E21B 23/04 166/120 |
| 6,401,824 | B1 | 6/2002 | Musselwhite et al. | |
| 6,679,336 | B2 | 1/2004 | Musselwhite et al. | |
| 6,866,100 | B2 * | 3/2005 | Gudmestad | E21B 34/06 166/166 |
| 8,074,718 | B2 * | 12/2011 | Roberts | E21B 43/10 166/319 |
| 9,222,334 | B2 * | 12/2015 | Erkol | E21B 34/06 |
| 2006/0272825 | A1 * | 12/2006 | Royer | E21B 34/14 166/373 |
| 2008/0196903 | A1 | 8/2008 | Wardley et al. | |
| 2011/0266472 | A1 * | 11/2011 | Russell | E21B 21/106 251/28 |
| 2013/0000917 | A1 | 1/2013 | Slack et al. | |
| 2013/0025711 | A1 * | 1/2013 | Russell | E21B 21/10 137/512 |
| 2013/0082202 | A1 * | 4/2013 | Morrison | E21B 33/14 251/315.01 |
| 2014/0144526 | A1 * | 5/2014 | Russell | E21B 21/10 137/512.2 |

* cited by examiner

PILOT INSIDE A BALL SUITABLE FOR WELLBORE DRILLING OPERATIONS

RELATED APPLICATION

This application is a continuation-in-part application that claims priority to the co-pending U.S. patent application having the Ser. No. 14/880,929, entitled "Pilot Inside A Ball Suitable For Wellbore Operations," filed Oct. 12, 2015. The above-referenced patent application is incorporated by reference herein in its entirety.

FIELD

The present invention relates, in general, to an apparatus, system and method for controlling fluid flow inside a tubular in a wellbore. More particularly, the invention relates to a pilot inside a ball for controlling fluid flow in subterranean environments during hydrocarbon drilling operations, including oil and gas wells.

BACKGROUND

The oil and gas industry utilizes check valves for a variety of applications, including oil and gas wellbore operations. A check valve is a mechanical device that permits fluid to flow, or pressure to act, one-way or in one direction only. Check valves are utilized in oil and gas industry applications, in particular involving fluid control and safety. Check valves can be designed for specific fluid types and operating conditions. Some designs are tolerant of debris, whereas others may obstruct the bore of the conduit or tubing in which the check valve is fitted. Conventional check valves are known to have reliability issues due to wear problems. This is a consequence of flow for an open valve continually passing both the seat and the sealing plug or ball of those check valves. These reliability issues lead to valve failure, particularly in abrasive flow applications or when larger objects flow through the valve. Oilfield operations can cause conventional pilots (mechanisms designed to restrict and guide fluid flow, e.g., poppet valves, ball valves, flapper valves, and chokes) to leak due to corrosion of the seat and valve during the operations. The use of check valves is important in the oil & gas industry as reliable check valves can protect against loss of well control, including well blowouts.

A check valve should be engineered to be operable in high stress and vibration environments, including drilling operations in a wellbore that increase wear on the constituent valve components. The wear problem is compounded in abrasive environments, such as high fluid pressure drilling, muds or slurries.

In general, check valves are typically used immediately above the drilling bits on the drill string in oilfield drilling and are typically referred to as "check valves" in the industry. While all components in a drill string are subject to relatively high vibrations, check valves are exposed to very high vibrations, including accelerations of up to 10 g (gravity) or more while flow passes, often in excess of 600 gallons per minute. Relative motion of the adjacent parts on wellbore equipment in the abrasive subterranean fluid environment increases wear on the wellbore equipment, which can cause misalignment between a sealing member of a valve and its valve seat.

Oil and gas operation check valves, as disclosed by U.S. Pat. Nos. 3,870,101, 6,401,824, 6,679,336, and U.S. Patent Application Nos. 2013/0082202 and 2014/0144526 utilize pilots to control fluid flow in high vibration oil and gas operations. However, these check valve devices suffer from corrosion on the seats and seals located inside the valves, due to the abrasive action of direct fluid flow as discussed above.

There is a need for a more reliable check valve that is designed to improve reliability by reducing corrosion from direct fluid flow on the seat and/or seals of the check valve.

Embodiments of the check valve, disclosed herein, achieve these needs.

SUMMARY

The present disclosure is directed to a valve and method of use therefor, suitable for use in subterranean drilling. In an embodiment, the valve comprises a ball sized to fit inside a tubular body. The tubular body comprises a bore for fluid flow inside the tubular body, with a ball located within the bore of the tubular body. The ball itself also comprises a bore, such as an opening or channel suitable for fluid flow. The ball further comprises at least one pilot within the bore of the ball permitting one-way fluid flow. The contact between the inner surface of the tubular body bore and the ball can define a seat, wherein the seat prevents fluid flow between the ball and the tubular body. In this embodiment, a pusher rod contacts the ball. Alternatively, in certain embodiments, the seat could be defined as the section where fluid flow is obstructed. The pusher rod can comprise a cylindrical shape having a first end and a second end connected by an internal bore, located between the first end and the second end and having an internal diameter. This internal diameter may increase toward the first end opening and the second end opening (i.e., a dual funnel configuration) with at least one opening shaped to match a corresponding exterior contour and diameter of the ball. Rotation of the bore of the ball away from the internal diameter of the pusher rod prevents fluid flow through the ball, while rotation of the bore of the ball in alignment to the internal diameter of the pusher rod permits one-way fluid flow. The pusher rod and the bore of the tubular body may additionally comprise at least one seal to prevent fluid flow between the pusher rod and the bore of the tubular body.

The present disclosure is further directed to a method for controlling fluid flow inside a wellbore during drilling operations. In one embodiment, the method comprises the steps of inserting a tubular device with a bore for fluid flow into a wellbore. The tubular device comprises a ball designed to fit inside the tubular device, and the ball comprises a bore with at least one pilot. The apparatus additionally comprises a pusher rod contacting the ball, wherein the pusher rod comprises a cylindrical shape, a first end opening and a second end opening. These openings are connected by an internal bore therebetween having an internal diameter. The inside of the tubular body can comprise at least one seal to prevent fluid flow between the pusher rod and the inside of the tubular device. In this embodiment, the method further comprises "opening" the ball by exerting pressure on the pusher rod to enable fluid flow therethrough by aligning the internal bore of the pusher rod with the internal bore of the ball and pressurizing fluid through the pilot into the wellbore below the tubular device. The method also enables cessation of fluid flow by decreasing pressure on the pusher rod, causing the ball to rotate until the internal bore of the pusher rod is aligned with the exterior surface of the ball.

The present disclosure is further directed to a system for controlling fluid flow movement inside wellbore tubulars during drilling operations. The fluid flow system comprises a ball designed to fit inside a tubular body, and the tubular body comprises a bore for fluid flow inside the tubular body. In this embodiment, the ball comprises a bore, with at least one pilot inside the bore of the ball permitting one-way fluid flow. The ball can rotatably fit inside the tubular body and the intersection of the bore of the tubular body and the ball can define a seat. The seat prevents fluid flow between the ball and the tubular body.

In this embodiment of the system for controlling fluid flow, a pusher rod, comprising a cylindrical shape having a first end and a second end connected by an internal bore therebetween, contacts the ball. The internal diameter of the internal bore of the pusher rod can increase from the center towards the first end opening and the second end opening, to match a corresponding exterior contour of the ball. Rotation of the bore of the ball away from the internal bore of the pusher rod prevents fluid flow through the ball, while rotation of the bore of the ball in alignment with the internal bore of the pusher rod permits one-way fluid flow. The pusher rod and the inside of the tubular body can comprise at least one seal to prevent fluid flow therebetween. A control device selectively controls the opening of the pilot through fluid flow and controls the closing of the ball through pressure exerted on the pusher rod.

The foregoing is intended to give a general idea of the invention, and is not intended to fully define nor limit the invention. The invention will be more fully understood and better appreciated by reference to the following description and drawings.

BRIEF DESCRIPTION OF THE DRAWINGS

In the detailed description of various embodiments usable within the scope of the present disclosure, presented below, reference is made to the accompanying drawings, in which.

Figure 1:
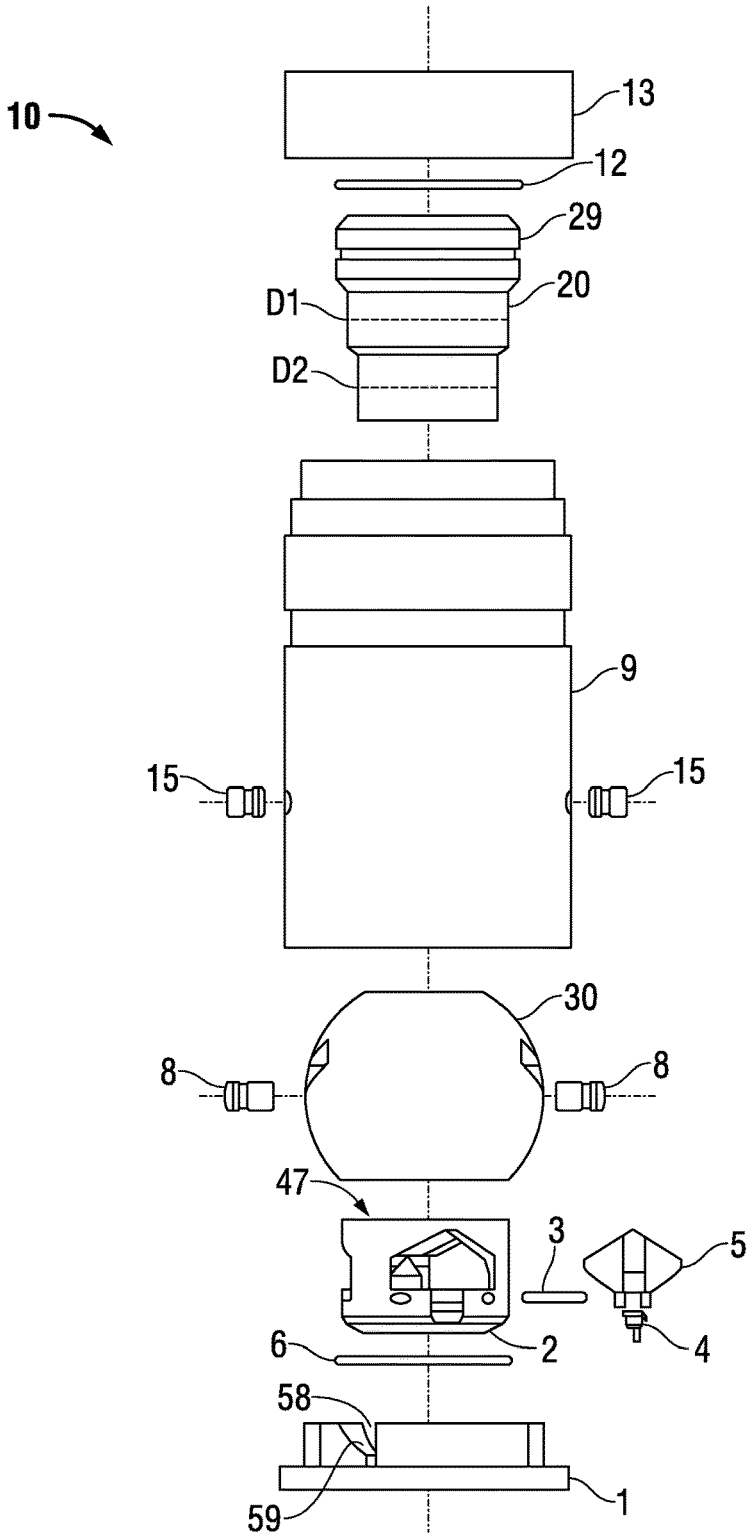
FIG. 1 depicts a schematic of the ball pilot apparatus according to one embodiment in accordance with the present disclosure.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

In general, an embodiment of the valve system is directed to an apparatus, system and method for controlling fluid flow inside well tubulars within a wellbore. The valve can be operated by selective control of pressure and fluid flow by utilizing a ball sized to fit inside the bore of the housing. At least one (and up to ten) pilots (e.g., flapper valves) may be engineered to fit inside the ball. The ball has a generally round profile with an internal bore therethrough permitting internal fluid flow through a tubular, drill string or other wellbore tool, with the pilot(s) allowing one-way fluid flow.

A pilot is any device that can restrict or prevent fluid flow in at least one direction. Examples of pilots include, but are not limited to: flapper valves, selective membranes, one-way valves, poppet valves, ball valves (i.e., a secondary ball-in-ball construction), pressure valves, chokes, or combinations thereof. Persons skilled in the art will recognize additional devices that can restrict fluid flow in one direction and are suitable for use as a pilot alongside the present invention. For purposes of brevity, the bulk of the present disclosure describes an embodiment utilizing a flapper valve pilot, which is not meant to be limiting.

In an embodiment, the ball is designed to rotate against a seat, inside the housing, against a pusher rod on top. The pusher rod has a generally cylindrical shape with two ends connected by an internal bore of the pusher rod, with the internal diameter of the pusher rod permitting fluid flow between the two ends. The pusher rod has a funnel top shape with the cylindrical top end angled outward toward the first end opening for favorable fluid flow, with the second end also angled outward toward the second end opening to match the corresponding exterior contour of the ball. In one embodiment, the angle of the second end opening matching the exterior contour of the ball prohibits any fluid flow, or at least prohibits direct fluid flow, outside of the respective bores of the ball and pusher rod. The rotation of the ball seals off fluid flow by rotating the internal bore of the ball away from the internal bore of the pusher rod.

In an embodiment, the design of the pusher rod and the ball allows fluid flow without any fluid contacting the seals and/or seats where the ball contacts the housing. This design allows for greater fluid flow, including drilling fluids such as, mud flow, without the seals and/or seat being worn or damaged by the impact of said fluid flow.

In one embodiment, the pusher rod can have an exterior diameter and an O-ring seal on the exterior diameter of the pusher rod to contour, or match, a corresponding interior diameter of the housing, and thus prevent fluid flow outside of the pusher rod. In one embodiment, the seal on the exterior of the pusher rod is protected from fluid flow by the shape of the exterior diameter, wherein the seal is below a section that extrudes outwardly to match the contour of the ball. The valve is designed to both permit and prevent fluid flow without any fluid flow contacting the seat and seals, such as the seal on the exterior of the pusher rod. In a float collar embodiment, the ball with the pilot device is placed inside a tubular on the drill string to facilitate fluid flow through the drilling string.

While various embodiments usable within the scope of the present disclosure have been described with emphasis, it should be understood that within the scope of the appended claims, the present invention can be practiced other than as specifically described herein. It should be understood by persons of ordinary skill in the art that an embodiment of the fluid control apparatus, system and method in accordance with the present disclosure can comprise all of the features described above. However, it should also be understood that each feature described above can be incorporated into the valve apparatus 10, the ball 30 and pusher rod 20 by itself or in combination, without departing from the scope of the present disclosure, as shown in FIG. 1.

FIG. 1 illustrates an embodiment of the apparatus 10 showing a ball 30 containing the pilot housing 2 and contacting the pusher rod 20. The ball 30 has an internal bore 31 in the center (not visible in FIG. 1) containing pilot housing 2. The pilot housing 2 in turn has an internal bore 47 for fluid flow containing a pilot 5 (shown in this embodiment as a flapper valve) that is connected to the pilot housing 2 by pin 3 and spring mechanism 4, in the embodiment shown in FIG. 1. In this embodiment, ball 30 is inserted into a housing 9 through the use of two ball center pins 8 that can be inserted into lugs 15 in the housing 9, as shown in FIG. 1. The ball center pins 8 and corresponding lugs 15 permit pivoting, or rotational movement, of the ball 30 inside the housing 9. The ball 30 and pilot housing 2 are also held firmly in place by a lower ball stop 1 and a ball retainer ring 6 between the pilot housing 2 containing the ball 30 and lower ball stop 1. Lower ball stop 1 features gaps 58 and curves 59 on the interior wall sections, which can help direct debris toward the opening 51 of the bore 52 (not visible in FIG. 1). In an embodiment, the housing 9 can be a tubular or a modified joint of pipe that can be used in a wellbore.

The pusher rod 20 is cylindrically shaped with an internal bore 21 (not visible in FIG. 1) and is designed to move and/or pivot inside the housing 9. The area of contact between the exterior of the pusher rod 20 and/or the ball 30 and the interior of the housing 9 is known as the seat 60 (not visible in FIG. 1). As further shown in FIG. 1, the pusher rod 20 typically has a section with a larger exterior diameter D1 for contacting the interior of the housing 9, while the section contacting the ball 30 has a diameter D2 less than the larger exterior diameter D1. In the depicted embodiment, the section of the housing 9 with diameter D1 is depicted with a groove 29 for receiving a seal such as an O-ring 12 that can be used to seal the contact between the exterior of the pusher rod 20 and the interior of the housing 9 in order to prevent any fluid flow into the seat. Also in the depicted embodiment, the pusher rod 20 is held firmly in place by a top cap 13.

Figure 2:
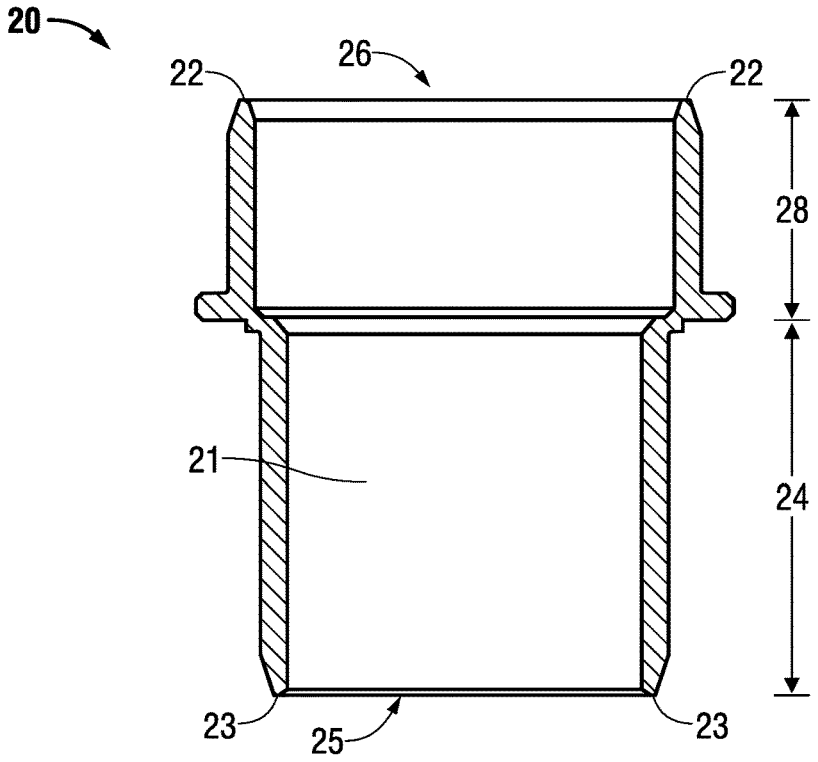
FIG. 2 depicts a cross-sectional view of one embodiment of a ball pusher.

Turning now to FIG. 2, the figure depicts a cross-sectional view of an embodiment of the pusher rod 20. The pusher rod 20 has a generally cylindrical shape with two ends 22, 23 connected by an internal bore 21 of the pusher rod 20, with the internal bore 21 of the pusher rod permitting fluid flow between upper end 22 and lower end 23. In one embodiment, the pusher rod has a double-ended funnel shape with the internal bore 21 angled outward toward the upper end 22 opening 26 for favorable fluid flow, and the internal bore 21 lower end 23 opening 25 angled outward to match a corresponding curved exterior contour of the ball 30, as shown in FIG. 1.

FIG. 2 illustrates an additional embodiment wherein the internal bore 21 has a lower section 24 that has a consistently smaller diameter D2 than the upper section 28 diameter D1.

Figure 3:
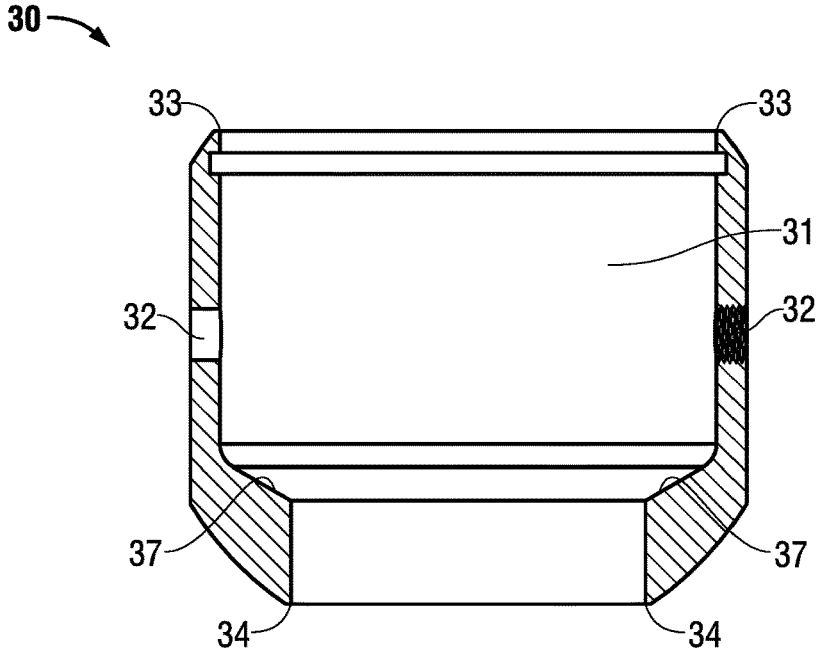
FIG. 3 depicts a cross-sectional view of one embodiment of a ball.

Turning now to FIG. 3, depicted is a close-up view of the ball 30. The ball 30 may be any device with rounded sections that can be made to pivot. The rotation of the ball 30 can seal off fluid flow by rotating the internal bore 31 of the ball away from the internal bore 21 of the pusher rod 20 based on fluid flow. The funnel shape of the lower end 23 of the internal bore 21 of pusher rod 20 allows a small amount of fluid flow through the pusher rod 20 to provide enough pressure to maintain constant, or at least sufficient, contact between the ball 30 and the pusher rod 20.

In the depicted embodiment, the ball 30 has an internal bore 31 for fluid flow and is pivotally mounted to housing 9 by mounts 32. In one embodiment, the mount is a hole for screws or bolts to be inserted that allow for rotational motion of the ball 30. In the embodiment shown in FIG. 3, the ball 30 comprises a curved interior diameter 37 for seating the pilot housing 2, as shown in FIG. 1, which may contain at least one and up to ten pilots 5 (shown as flappers) to allow one-way fluid flow through the ball 30. In the embodiment shown in FIG. 3, the upper end 33 of the internal bore 31 of the ball 30 has a larger interior diameter than the lower end 34 of the internal bore 31 of the ball 30. This design provides for favorable fluid flow in that a small amount of fluid flow can direct the ball 30 to rotate and align the internal bore 31 with the internal bore 21 of pusher rod 20, as described above.

Figure 4A:
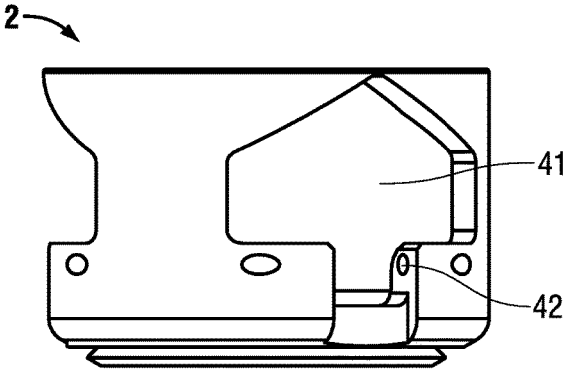
FIG. 4A is an exterior view of the pilot housing.
Figure 4B:
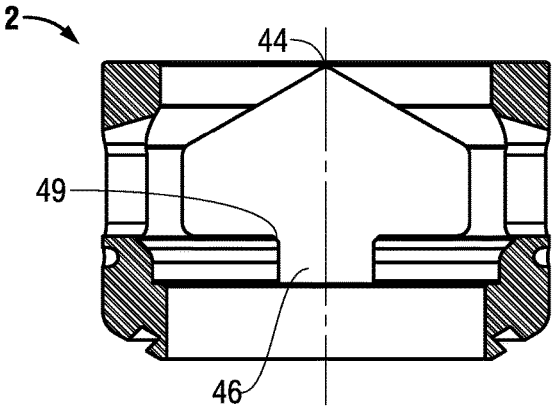
FIG. 4B is a cross-sectional view of the pilot housing with a flapper.
Figure 4C:
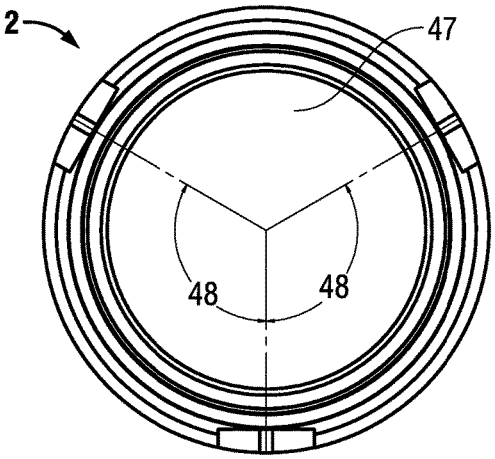
FIG. 4C is a plan view depicting the pilot housing and the interior bore.

Turning now to FIGS. 4A-4C, the figures illustrate different views of the pilot housing 2, which is designed to fit inside the ball 30. FIG. 4A is an exterior view of the pilot housing 2. In the embodiment shown, the pilot housing 2 has orifices 41 machined or cut out of the exterior for the pilot(s) 5, and holes 42 for pilot pins 3 to hold the pilots 5 which, in this example are flappers, to the pilot housing 2. The pilot(s) 5 can open and close using springs or other devices (not shown) that allow the pilot(s) 5 to selectively open with one-way fluid flow but close with no fluid flow or fluid flow in the other direction.

FIG. 4B is a cross-sectional view of the pilot housing 2 showing a pilot 5. In this embodiment shown in FIG. 4B, the pilot 5 has a point 44 on one end and a chamfer section 49 leading to base 46 that is attached to the pilot housing 2. Secondary groove 45 is located at the end opposite point 44 and can receive an off-the-shelf seal made of rubber or any suitable elastomer. FIG. 4C is a plan view showing the pilot housing 2 and the cavity or interior bore 47.

In the embodiment shown in FIG. 4C, a cross-sectional view shows three pilots 5 (shown as flappers) utilized, with all three pilots 5 having equal size with an equal angle arrangement, wherein each pilot covers 120 degrees of the interior diameter radius 48 of the portion of the bore 47 in the pilot housing 2 aligned with the ball 30. This arrangement of pilots 5 can provide favorable flow control as each pilot covers an equal area, and can allow small changes in fluid flow to open and close the pilots 5, and also selectively rotate the ball 30. For example, pressure acting on a bottom section of the ball will rotate the ball 30 so that the internal bore 31 of the ball 30 is directed away from the internal bore 21 of the pusher rod 20 and/or the internal bore 47 of the housing 9, thus preventing fluid flow through the ball 30. The bottom section will typically be, for example, adjacent to the lower end 34 of the internal bore 31 of the ball 30, as shown in FIG. 3. However, depending on the rotation or pivot of the ball 30, the bottom section can be any section of ball 30 adjacent to the wellbore region below the ball 30.

Figure 4D:
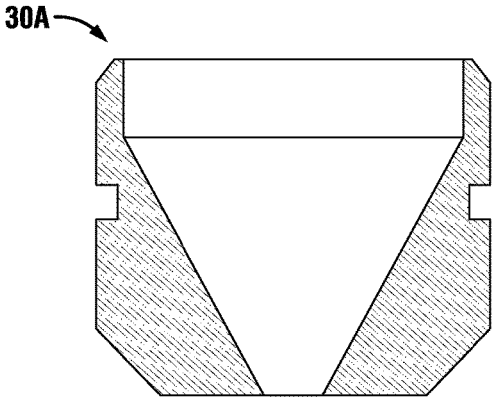
FIGS. 4D-4F are cross-sectional views depicting alternative embodiments of the ball pilot apparatus.
Figure 4E:
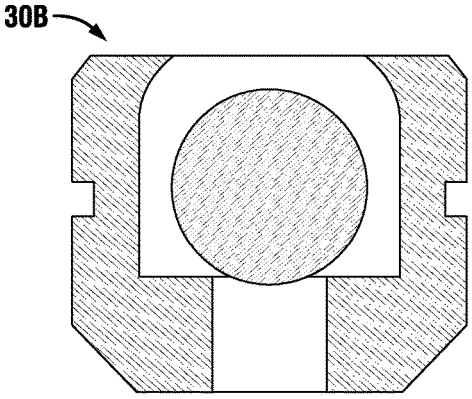
Figure 4F:
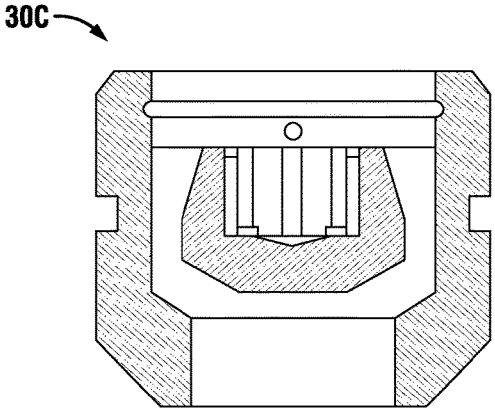

Turning now to FIG. 4D, three alternative embodiments of the ball 30 are illustrated with different pilots. In these alternative embodiments, flow is controlled by choke 30A, secondary ball 30B, or poppet valve 30C. These alternative embodiments are not meant to be limiting, as it may of course be understood by persons skilled in the art that any device or apparatus capable of restricting fluid flow may be used as a pilot 5 within ball 30.

Figure 5:
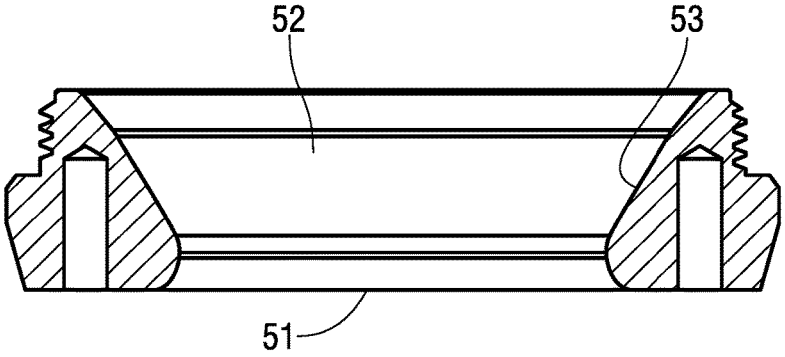
FIG. 5 is cross-sectional view depicting a ball stop.

FIG. 5 is cross-sectional view of a lower ball stop 1. As explained above, the lower ball stop 1 is designed to hold the ball 30 firmly in the housing 9 or tubular device. In the depicted embodiment, the ball stop 1 is designed to favorably handle contaminants and debris in the fluid flowing through the housing 9. As depicted, lower ball stop 1 comprises a bore 52 having a curved interior diameter 53. The curved interior diameter 53 of bore 52 preferably directs the fluid flow toward the opening 51 of bore 52 of ball stop 1 to help quickly remove any debris by directing or concentrating the fluid flow towards the opening 51 of bore 52. In addition, gaps 58 and curves 59 on the interior wall sections of the ball stop 1 can help direct debris toward the opening 51 of the bore 52, as shown in FIG. 1 and FIG. 5.

Figure 6:
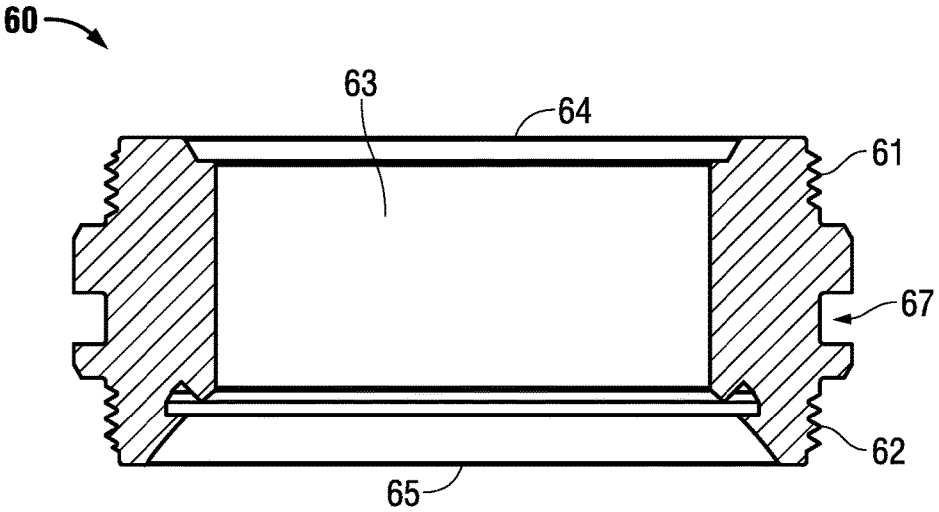
FIG. 6 is cross-sectional view depicting a seat section.

FIG. 6 is a cross-sectional view of a seat section 60 that can be either formed out of housing 9 or formed separately and inserted into housing 9. In the embodiment shown in FIG. 6, the seat device 60 is formed separately and screwed inside the housing with the use of top threads 61 and bottom threads 62. This seat shown is a cylinder with a bore 63 having an internal diameter with the upper end 64 designed to house the pusher rod 20 and the lower end 65 designed to house the ball 30. A groove 67 is shown that can be used to insert a sealing device, such as an O-ring, to further prevent fluid flow where the seat section 60 contacts the housing 9 (depicted in FIG. 1). In this embodiment, the seat section 60 is where the ball contacts the interior of the seat device 60 inside the tubular and is designed to prevent direct fluid flow outside of the interior of the valve. In addition, the groove 67 can prevent any fluid flow directly onto the seal within. This increases the life of the seal and improves valve apparatus reliability. Secondary groove 68 can also be used to house any suitable off-the-shelf sealing element such as rubber or another elastomer.

Drill String

Figure 8A:
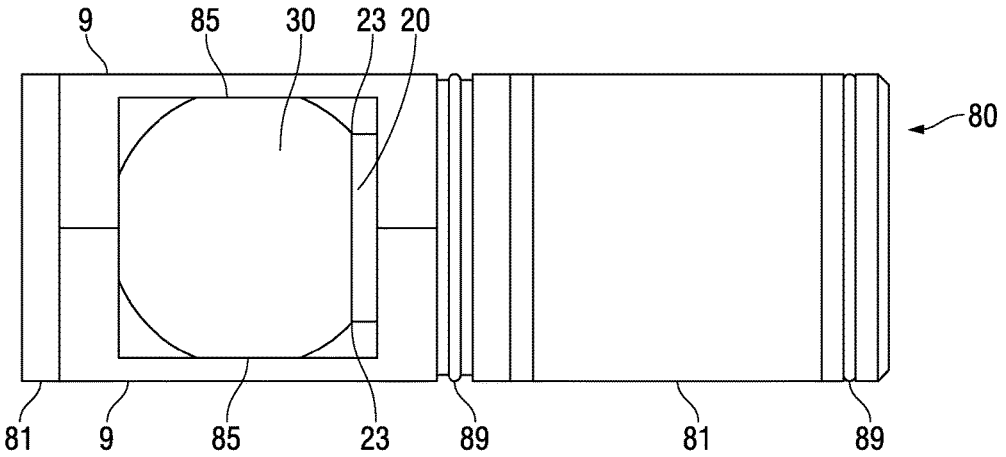
FIG. 8A illustrates a ball valve, in the closed position, inside a tubular 81 that can inserted into a drill string.

In one embodiment, the ball with an internal valve and a pusher rod is used during drilling operations as a check valve on a drill string. FIG. 8A illustrates a ball 30 with the internal valve, in the closed position, inside a tubular 81 that can inserted into a drill string. As shown in FIG. 8A, the valve device 80 comprises a ball 30 inside the tubular 81 that is suitable to be attached to a drill string (not shown). Typically, the valve would be attached slightly above the drill bit.

The ball valve comprises one or more pilots 5 inside the internal bore 47 wherein the pilots 5 are suitable to control fluid flow in one direction, as discussed above. In FIG. 8A, the ball 30 is rotated to be in the closed position thus preventing any fluid flow inside the ball valve internal bore 47. Fluid flow is prevented outside of the internal bore 47 of the ball 30 by the seat 85. The seat 85 is shown as the section where the exterior of the ball valve 30 contacts the interior of the housing 9 in FIG. 8A. In one embodiment, threaded sections 89 may connect sections of the valve, such as, additional seat sections (60, as shown in FIG. 6) or connect the valve with the drill string tubular 81.

Figure 8B:
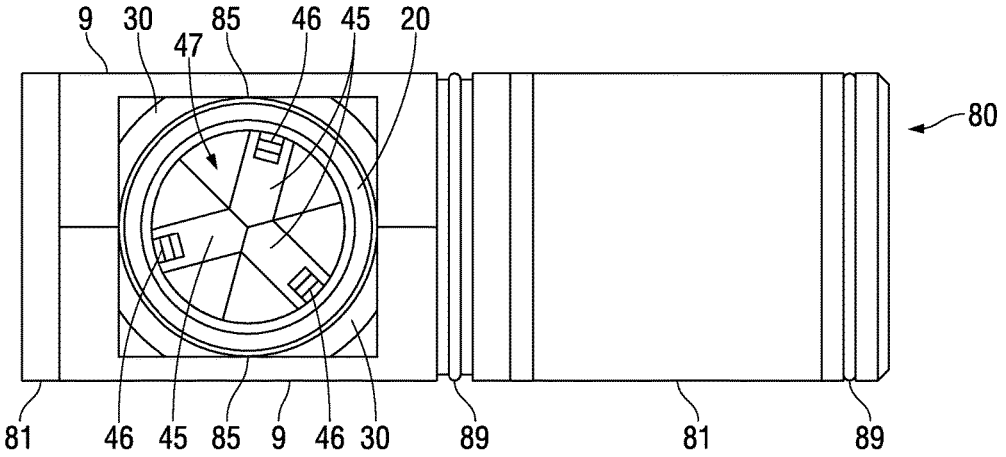
FIG. 8B illustrates a ball valve, in the open position, inside a tubular 81 that can inserted into a drill string.

In FIG. 8B, the ball 30 is rotated to be in the open position by pressure or fluid flow exerted on the pusher rod 20. In FIG. 8B, fluid flows through the internal bore (not shown) of the ball 30 in only one direction because of the one or more pilots 5 inside the ball 30, as described above.

Figure 9A:
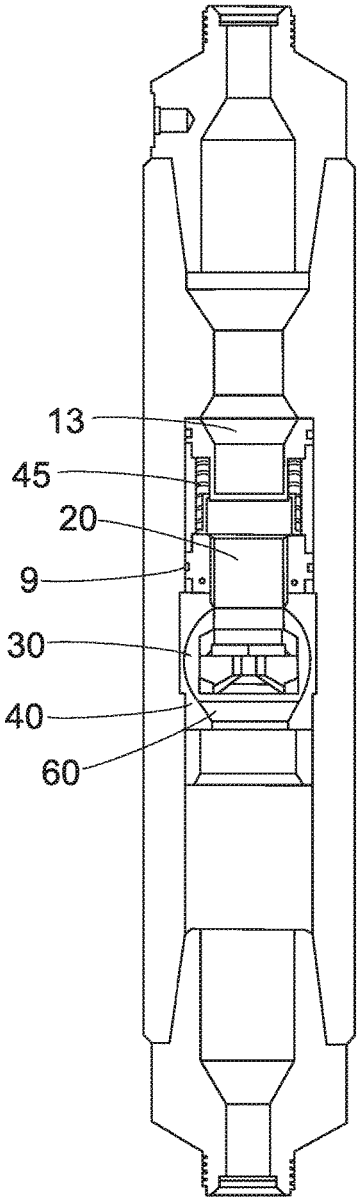
FIG. 9A illustrates a cross-sectional view of another embodiment of the invention located within a string, in the open position.
Figure 9B:
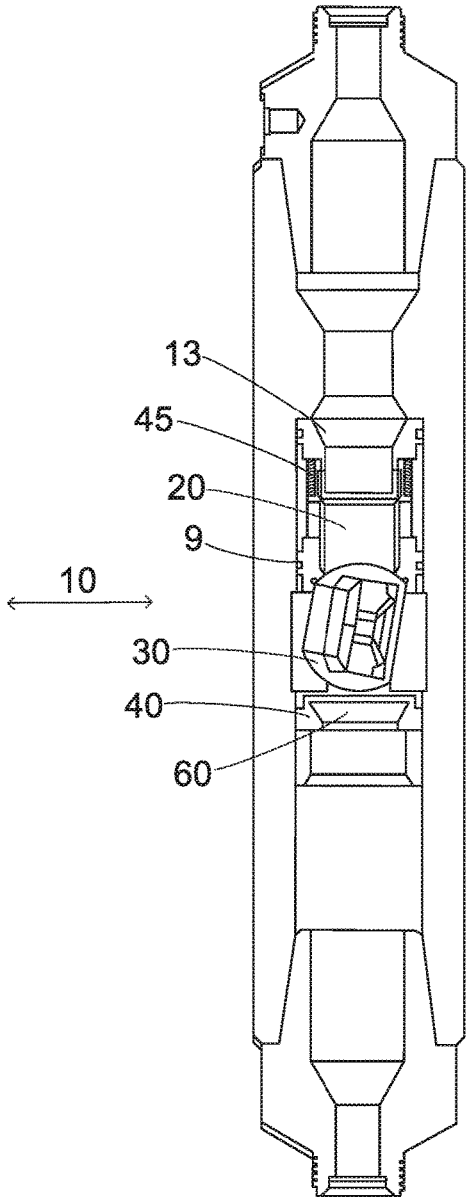
FIG. 9B illustrates a cross-sectional view of another embodiment of the invention located within a string, in the closed position.

Turning now to FIGS. 9A and 9B, another embodiment of the valve assembly 10 is shown in lateral cross-section. The valve assembly 10 is depicted with the ball 30 rotating between an open position as shown in FIG. 9A and a closed position as shown in FIG. 9B. In addition to the ball 30, the pusher rod 20, the top cap 13, and the seat 60, this embodiment additionally comprises bypass 40 and a compressible spring mechanism 45 between pusher rod 20 and top cap 13. Notably, in addition to the one-way flow enabled by the other embodiments, the embodiment depicted in FIGS. 9A and 9B can enable a limited reverse fluid flow through bypass 40, located within seat 60. Bypass 40 directs fluid flow around ball 30 and pusher rod 20, through top cap 13. The limits of the reverse fluid flow can be predetermined by the strength of spring mechanism 45; as long as the pressure differential does not exceed this predetermined level, the fluid flows upward around ball 30 and pusher rod 20, through top cap 13. However, once the pressure exceeds this amount, pusher rod 20 is forced upward to contact top cap 13. This can allow ball 30 to rotate and thereby seal off the pusher rod 20. (This can result in a very limited fluid flow across the seal 60, but only to the extent required to fill the space between the rotated ball 30 and housing 9.)

The exterior diameter of the valve or the housing containing the valve would typically have an outer diameter of at least 4 inches and less than 10 inches. The length of the valve or housing containing the valve would range from at least 12 inches and up to 48 inches. The valve can be connected to the drilling sting with a box connection, pin connection, and combinations thereof.

In one embodiment, a drill string, having the ball 30 and pusher rod 20 attached therein, is lowered for example, floated, while the valve remains closed. Typically, this embodiment involves an accumulator with a nitrogen pressure system for controlling pressure inside the drill string. The rotation of the ball can be selectively controlled by the accumulator using fluid flow, pressure or combinations thereof. Accordingly, a control panel can remotely control both the accumulator and the valve inside the ball by controlling pressure or fluid flow on the pusher rod.

An accumulator section is typically located between the outer housing and an inner sleeve of the tool such as, float valve. The accumulator is pre-charged with nitrogen. The pressure from the accumulator is applied to the top side of a pusher rod attached to a ball valve at the lower end of the device, via cam arms. Downward movement of the pusher rod closes the valve. When it is no longer desirable to float the drill string while the valve is closed, fluid is pumped into the interior of the drill string. The fluid passes through the drill string to apply pressure to the bottom side of the piston or pusher rod. When the hydrostatic pressure of the drilling or wellbore fluid, pushing upward against the bottom of the push rod, exceeds the pressure such as, nitrogen pressure pushing downward, the pusher rod is raised and the valve is opened.

In an alternative embodiment, the drill string can then be lowered while the valve is open, allowing backflow through the valve. When the pressure difference between the interior of the string and the accumulator exceeds a preset value, based on the threshold of an additional mud admission valve located in the inner sleeve, fluid from the drill string is permitted to pass through a mud admission valve located above the pusher rod and enter the accumulator, where it is separated from the nitrogen chamber by a floating piston. This increases the accumulator pressure until it is close to the pressure within the drill string, but does not increase the pressure sufficiently to open the valve.

At any point, when it is desired to close the valve, flow from the pump providing fluid into the drill string can be ceased. Because the passage of drilling fluid through the mud admission valve has retained the accumulator pressure close to the hydrostatic pressure in the drill string, this small reduction in pressure on the bottom side of the piston allows the accumulator pressure to move the piston downward to close the valve.

When it is desired to open the valve, flow from the pump can be restored. Once the pressure in the drill string pushing upward on the piston exceeds the accumulator pressure, the piston is moved upward to open the valve. When removing the drill string from the well, when the pressure within the accumulator exceeds that outside of the device, a popoff valve allows mud to vent from the accumulator, so that when the valve reaches the surface most or all of the drilling fluid has flowed out from the accumulator, and only the initial pressure from the nitrogen is present.

Drilling Safety Check Valve

In one embodiment, the ball with the internal valve and pusher rod is used as a drilling safety check valve on a drill string. The drilling safety check valve is typically run, or inserted, between the bit motor and the Measurement While Drilling (MWD) tools. As discussed above, the valve or housing includes a ball valve and a seat to seal off pressure, to prevent any flow of fluid or gas, up the drill string, and thus prevents well control problems. In one embodiment, the ball with the internal valve and pusher rod is used as a drilling safety check valve on a drill string The drilling safety check valve is opened during drilling or circulating operations, and the valve is closed if fluid or gas flows up the drill string, at a rate of at least 3 gallons per minute and less than 7 gallons per minute and at least 7 pounds per square inch of pressure differential across the valve. The flow and differential pressure actuate the ball valve to turn the seat for isolating pressure and flow below the drilling safety check valve, to prevent any upward fluid flow. The maximum pressure differential across the valve can be up to 10,000 pounds per square inch.

In one embodiment, the drilling safety check valve would allow pressure at the bit to be automatically communicated to the standpipe pressure gauge when pumps are off and the pipes are connected because the valves are open. Accordingly, the drilling safety check valve can assist with downhole pressure monitoring while drilling and can be used during under balanced drilling operations such as, air drilling. Furthermore, the drilling safety check valve can be used eliminate the need to stab the pressure valve at the surface while the well is flowing due to its reliability and pressure sealing design. Examples of safety pressure valves at the surface include but are not limited to: Texas Iron Work (TIW) valve, or Blow-Out-Preventer (BOP) valves, snubbing valves, and combination thereof.

The embodiments of the drilling safety check valve, discussed above, provide many advantages. These advantageous include but are not limited to: long service life in abrasive flow, high pressure capabilities with elastomeric to metal sealing, valves protected from fluid flow, valve activation with minimal pressure drops, non-slamming, high vibration resistance, adaptable to diverse subterranean conditions, well control, and combinations thereof.

Material

The ball 30 may be made of any suitable material for use in a wellbore. In one embodiment, the material of the valve is chosen to be drillable in the event the valve gets stuck during drilling operations. In particular, the material should be chosen to be easily drillable with an oil and gas drill bit, including a polycrystalline diamond compound (PDC) drill bit. A PDC drill bit has diamonds and special cutters and does not necessarily have rollers. In another embodiment, at least a majority of the material is composed of the same drillable material. Having only one material for the apparatus, or at least one material for the valve, allows for uniform expansion and contraction during high heat environments typically encountered in the course of well operations. Metal typically works well as a material, especially aluminum which has tolerance for high heat applications while also being easily drillable. In addition, the material should be easily formed, machined and/or millable to create the individual components, as described above. The material should be chosen to handle the wide range of pressures and temperatures experienced in a wellbore. Other suitable materials include, but are not limited to: plastics, cast iron, milled aluminum, steel, graphite composites, carbon composites or combinations thereof. Persons skilled in the art will recognize other materials that can be used in the makeup of the valve. The above list is not intended to be limiting and all such suitable materials are intended to be included within the scope in this invention.

Method

Figure 7:
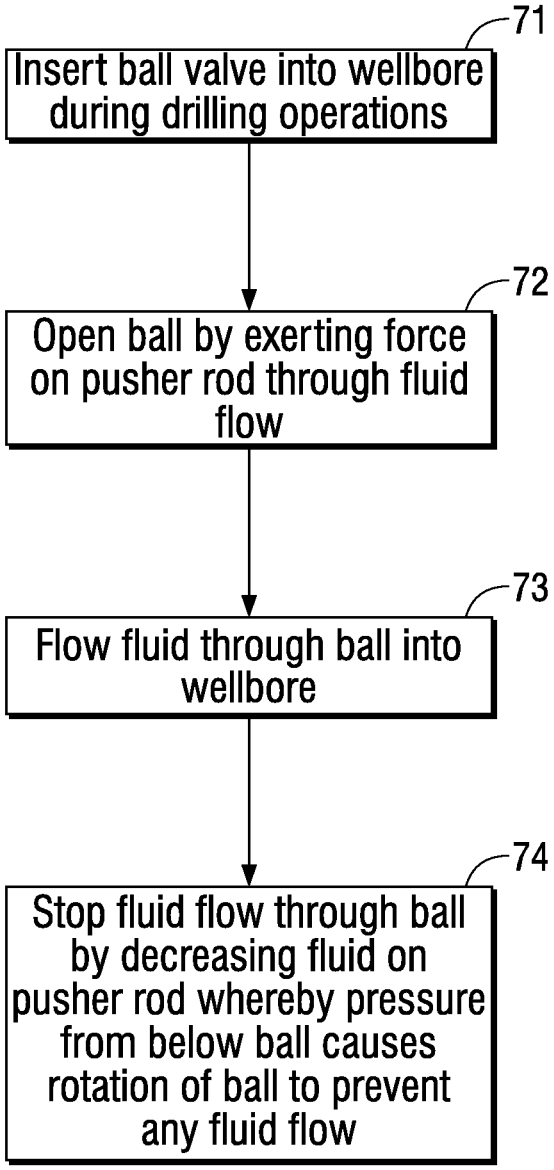
FIG. 7 is a flow chart illustration of a method embodiment.

FIG. 7 illustrates a flow chart of a method embodiment. As shown in FIG. 7, in one embodiment, the method comprises four steps. First, a ball with a pilot is inserted into a tubular in the wellbore during drilling operations 71. The ball pilot can include any apparatus described above that permits one-way fluid flow with a rotating valve that selectively facilitates one-way fluid flow based on pressure changes. Second, the ball is opened by exerting a force or pressure on the pusher rod through fluid flow 72. For example, this can occur through pumping fluids directly above the pusher rod. This enables fluid to be directed through the ball by aligning the internal bore of the pusher rod with the bore of the ball, and thus the pilot can allow one-way fluid flow. Third, fluid flows through the pilot into the wellbore below the tubular 73. This fluid flow can include, but is not limited to, casing mud, fracture fluid, acid treatments, and any combinations thereof. Finally, fluid flow is stopped 74. This can be accomplished by decreasing pressure (force) on the pusher rod by ceasing fluid pumping, and thus causing the ball to rotate, wherein the internal bore of the pusher rod is connected to the exterior surface of the ball. Back pressure in the wellbore will typically cause the ball to rotate when pumping above ceases. An operator can control or at least influence the pressure exerted on the ball through selective pumping of fluids. An accumulator, as described above, can be deployed and used to control the valve by controlling pressure and fluid flow on the pusher rod.

A system embodiment can be provided by adding a control system to the apparatus described above. The control system can selectively control the opening and closing of the valve. The valve can be opened by exerting pressure on the pusher rod and closed by eliminating, or at least reducing, any pressure on the pusher rod. The pressure is typically controlled by fluid flow but can also be controlled by air pressure against the pusher valve. Persons skilled in the art, with the benefit of the disclosure above, will recognize many suitable control devices for controlling the valve in the system. All such control devices are intended to be within the scope of this invention.

While various embodiments usable within the scope of the present disclosure have been described with emphasis, it should be understood that within the scope of the appended claims, the present invention may be practiced other than as specifically described herein.

What is claimed is:

1. A valve for use in subterranean drilling comprising:

a tubular housing comprising an inner surface and a bore for fluid flow inside the tubular housing;

a ball comprising an internal bore and a rounded external contour, wherein the ball is sized to rotate within the tubular housing;

at least one pilot located inside the internal bore of the ball, wherein the at least one pilot permits fluid flow in one direction;

a seat located along the bore of the tubular housing, wherein the seat prevents fluid flow between the ball and the tubular housing; and a pusher rod attached to the tubular housing with a compressible member, the pusher rod comprising a cylindrical shape, a first end, a second end, at least one seal, and an internal bore connecting the first end and the second end, wherein the first end and the second end each comprise an opening, wherein the internal bore comprises an internal diameter, wherein the first end opening is angled outward with the internal diameter increasing toward the first end opening and the second end opening is angled outward, wherein the internal diameter of the second end opening substantially matches a corresponding exterior contour of the ball, wherein the second end is rounded to substantially match the corresponding exterior contour of the ball, wherein rotation of the internal bore of the ball away from the internal bore of the pusher rod prevents fluid flow through the internal bore of the ball, and rotation of the bore of the ball towards the internal bore of the pusher rod permits fluid flow in the one direction through the internal bore of the pusher rod and the internal bore of the ball, and wherein the compression of the compressible member by the pusher rod creates a bypass space along the inner surface of the tubular housing permitting fluid flow around the pusher rod and within the inner surface of the tubular housing.

2. The valve of claim 1, wherein the tubular housing is a float valve on a drilling string.

3. The valve of claim 1, wherein the tubular housing is a safety check valve on a drilling string.

4. The valve of claim 1, wherein the fluid flow through the internal bore of the pusher rod and the internal bore of the ball does not directly impact the seat.

5. The valve of claim 1, wherein the fluid flow is in the one direction through the internal bore of the pusher rod and the internal bore of the ball does not directly impact the at least one seal.

6. The valve of claim 1, wherein the pilot is a flapper valve, selective membrane, one-way valve, poppet valve, a secondary ball in ball valve, pressure valve, or combinations.

7. The valve of claim 1, wherein a portion of the ball is located below the seat, and wherein the pusher rod extends from the ball through the seat, thereby directing fluid flow above the seat through the ball.

8. The valve of claim 1, wherein the pusher rod exerts selective pressure on the ball, thereby preventing any fluid flow from contacting the seat, the at least one seal, or combinations thereof.

9. A method for controlling fluid flow inside a wellbore device comprising the steps of:

inserting a tubular device on a drill string with a bore for fluid flow into the wellbore during drilling operations, the tubular device comprising a ball and a pusher rod connected to a spring, the ball and the pusher rod each comprising an internal bore and an exterior surface;

opening the ball by exerting pressure on the pusher rod to enable fluid flow through the ball, wherein the internal bore of the pusher rod is aligned with the internal bore of the ball;

allowing fluid flow through a pilot within the internal bore of the ball into the wellbore below the tubular device, wherein the pilot permits fluid flow in one direction; and stopping fluid flow through pressure from below the ball acting on a bottom section of the ball, thereby causing internal pressure on the ball to rotate the ball such that the internal bore of the pusher rod is aligned with the exterior surface of the ball; and allowing fluid flow around the pilot from the wellbore below the tubular device through pressure from below the pusher rod, compressing the spring via the pusher rod, and creating a bypass space along an inner surface of the tubular device.

10. The method of claim 9, further comprising providing at least one seal between the exterior surface of the pusher rod and the bore of the tubular device.

11. The method of claim 10, wherein fluid flow does not substantially impact the at least one seal.

12. The method of claim 9, wherein an end of the pusher rod is contoured to match a contour of the exterior surface of the ball.

13. The method of claim 9, wherein the step of exerting pressure on the ball with the pusher rod prevents any direct fluid flow external to the respective internal bores.

14. A fluid flow system for controlling fluid flow movement inside drill strings inside a wellbore, the fluid flow system comprising:

a tubular housing on the drill string comprising an inner surface and a bore for fluid flow inside the tubular housing;

a ball comprising a bore and a rounded external contour, wherein the ball is sized to rotate within the tubular housing;

at least one pilot located inside the internal bore of the ball, wherein the at least one pilot permits fluid flow in one direction;

a pusher rod attached to the tubular housing with a compressible spring, the pusher rod comprising a cylindrical shape, a first end, a second end, and an internal bore connecting the first end and the second end, wherein the first end and the second end each comprise an opening, wherein the internal bore comprises an internal diameter; at least one seal between the pusher rod and the internal surface of the tubular housing to prevent fluid flow from directly contacting a seat between the ball and the inner surface of the tubular housing; and a control device that controls the rotation of the ball through actuation of the pilot through fluid flow, force exerted on the pusher rod, pressure exerted on a bottom section of the ball, or combinations thereof, and wherein rotation of the bore of the ball away from the internal bore of the pusher rod prevents fluid flow through the ball and rotation of the bore of the ball in alignment with the internal bore of the pusher rod permits one-way fluid flow in a first direction, and wherein pressure on the pusher rod compresses the spring and permits fluid flow in a second direction.

15. The system of claim 14, wherein the at least one seal between the pusher rod and the inner surface of the tubular housing is inside a groove on the pusher rod.

16. The system of claim 15, further comprising an accumulator on the drill string and wherein the rotation of the ball is selectively controlled by the accumulator using fluid flow, pressure or combinations thereof.

17. The system of claim 15, wherein fluid flow does not substantially impact the at least one seal.

18. The system of claim 14, wherein the internal diameter of the internal bore increases towards the second end opening to match the rounded exterior contour of the ball.

* * * * *